US005349769A

United States Patent [19]

Okola

[11] Patent Number: 5,349,769

[45] Date of Patent: Sep. 27, 1994

[54] IMAGE PRESENTATION CARD

[76] Inventor: Frank Okola, 15 Hudson St., P.O. Box 040544, Staten Island, N.Y. 10304

[21] Appl. No.: 82,532

[22] Filed: Jun. 25, 1993

[51] Int. Cl.[5] ..... G09F 1/00

[52] U.S. Cl. ..... 40/124.1; 40/159; 281/31

[58] Field of Search ..... 40/154, 155, 159, 537, 40/124.1; 281/31, 38

[56] References Cited

U.S. PATENT DOCUMENTS

| | | | |
|---|---|---|---|
| 324,164 | 8/1885 | Raisbeck | 40/159 |
| 2,504,277 | 4/1950 | Otterson | 40/124.1 X |
| 3,309,805 | 3/1967 | Thomas | 40/159 X |
| 4,771,557 | 9/1988 | Bowman | 40/159 X |

FOREIGN PATENT DOCUMENTS

| | | | |
|---|---|---|---|
| 1926382 | 12/1970 | Fed. Rep. of Germany | 40/159 |
| 933820 | 5/1948 | France | 40/159 |
| 1421025 | 11/1965 | France | 40/159 |
| 400098 | 10/1933 | United Kingdom | 40/159 |

*Primary Examiner*—Brian K. Green
*Attorney, Agent, or Firm*—Richard L. Miller

[57] ABSTRACT

An image presentation card, comprising an image holder, constructed of a transparent sheet of polypropylene plastic. The plastic is bent twice, to form an image holder tab that is backed with pressure sensitive adhesive, and to form an image holder back, which is wrapped around behind the image and tucked into the image holder tab, for holding a ultrasound image within. The pressure sensitive adhesive that backs the image holder tab is used to mount the image holder to a mounting surface. The mounting surface comprises a window opposite the location where the image holder is mounted, so that the mounting surface may be bent, covering the image, except for a cropped portion that can be viewed through the window. The mounting surface may be further bent, to form a cover that can cover the window completely, to protect the image from light.

5 Claims, 1 Drawing Sheet

IMAGE PRESENTATION CARD

BACKGROUND OF THE INVENTION

The invention relates to an image presentation card, specifically adapted for protecting and presenting typically a fetal ultrasound image.

A fetal ultrasound is a common procedure in modern pre-natal care. Following the procedure, the OB/GYN physician often gives the parents a printout image from the ultrasound. This gesture is often well appreciated by the parents, who then wish to preserve it as a keepsake in their baby's scrapbook.

The paper that the image is printed on is thermographic paper, which is similar to fax paper. This paper is thin, and has a tendency to curl and crease. In addition, when the print paper comes into contact with acidic materials, or experiences heat, pressure or light for a sustained period of time, the image will dissipate.

The volatility of the image creates special storage problems for parents who wish to maintain it as a keepsake.

SUMMARY OF THE INVENTION

It is an object of the invention to produce an image presentation card that overcomes that shortcomings of the prior art.

It is another object of the invention to produce an image presentation card that will protect an ultrasound image from curling and creasing.

It is a further object of the invention to produce an image presentation card that will protect an ultrasound image from environmental contaminants.

It is still further object of the invention to produce an image presentation card that will not itself contribute to the decay of an ultrasound image.

It is a still further object of the invention to produce an image presentation card that will protect an ultrasound image from continuous exposure to light.

It is yet a further object of the invention to produce a image presentation card that is economical to manufacture.

The invention is an image presentation card, comprising an image holder, constructed of a transparent sheet of polypropylene plastic. The plastic is bent twice, to form an image holder tab that is backed with pressure sensitive adhesive, and to form an image holder back, which is wrapped around behind the image and tucked into the image holder tab, for holding a ultrasound image within. The pressure sensitive adhesive that backs the image holder tab is used to mount the image holder to a mounting surface. The mounting surface comprises a window opposite the location where the image holder is mounted, so that the mounting surface may be bent, covering the image, except for a cropped portion that can be viewed through the window. The mounting surface may be further bent, to form a cover that can cover the window completely, to protect the image from light.

To the accomplishment of the above and related objects, this invention may be embodied in the form illustrated in the accompanying drawings, attention being called to the fact, however, that the drawings are illustrative only and that changes may be made in the specific construction illustrated and described, within the scope of the claims.

BRIEF DESCRIPTION OF THE DRAWINGS

In the drawings, like reference numerals depict like elements throughout the several views. The drawings are briefly described as follows.

DETAILED DESCRIPTION OF THE PREFERRED EMBODIMENT

Figure 1:
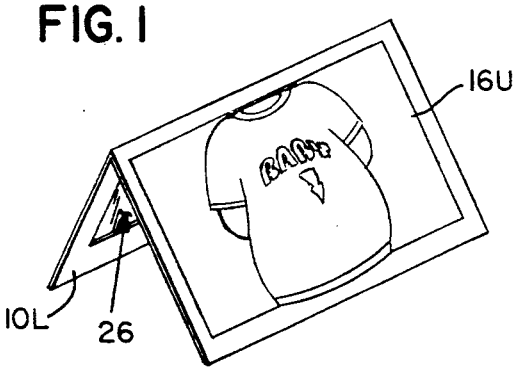
FIG. 1 is a diagrammatic perspective view of the instant invention.

In the embodiment of the image presentation card shown in the drawings, the mounting surface has eight panels, named as follows: upper front 10U, lower front 10L, upper inside front 12U, lower inside front 12L, upper inside rear 14U, lower inside rear 14L, upper rear 16U, and lower rear 16L. The mounting surface is constructed on a material that can be bent easily, and will maintain a fold or crease. Suitable materials include paper, cover stock, cardboard, and plastics.

FIG. 1 illustrates the image presentation card folded. In its finished form, the upper rear panel 16U becomes the front of the card. The upper rear panel 16U contains a graphic, as shown in FIG. 1. When opened, the image mounted on the lower inside rear panel 14L is viewed through a window in the lower front panel 10L. The upper rear panel 16U protects the image from continuous exposure to light by forming a cover, to selectively cover the image when it is not being viewed.

Figure 2:
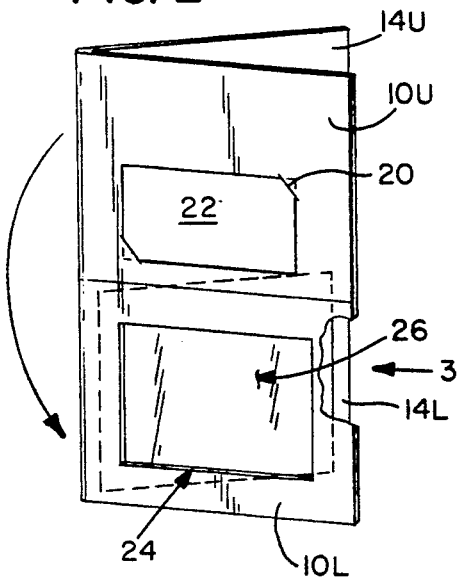
FIG. 2 is a diagrammatic perspective view of the instant invention partially unfolded.

FIG. 2 shows the image presentation card partially opened, as it is when the image is being viewed. The upper front panel 10U contains slit corners 20, for holding a business card 22. The lower front panel 10L has a window 24, for a cropped viewing of the image held in an image holder 26, which is mounted on the lower inside rear panel 14L. When the image presentation card is partially opened, the upper inside rear panel 14U lies behind the upper front 10U.

Figure 3:
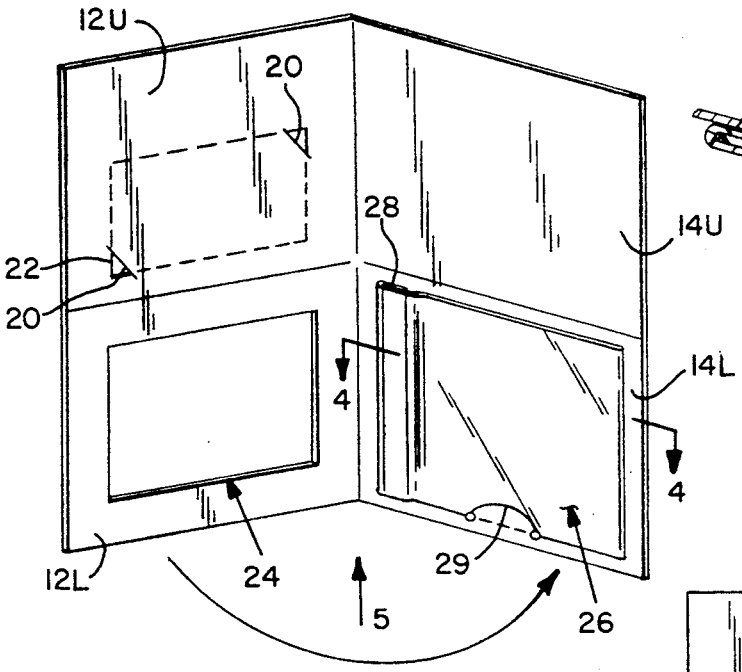
FIG. 3 is a diagrammatic perspective view of the instant invention completely opened, and nearly laid out flat of the side having the image holder.

FIG. 3 shows the image presentation card completely opened. When viewed in this position, corners of the business card 22, held in place on the upper front panel 10U, extend through the slit corners 20 to the upper inside front panel 12U. The portion of the business card 22 that is on the upper front panel 10U is shown in phantom.

The image holder has an image holder tab 28, which has a pressure sensitive adhesive backing, for mounting onto the lower inside rear panel 14L. The image holder 26 is further held into place with a circular tab 29 on the lower inside rear panel 14L. The circular tab 29 is simply a circular slit, within which the image holder 26 is tucked.

The window 24 in the lower front panel 10L extends through to the lower inside front panel 12L.

Fold lines separate the four panels shown in FIG. 3. The direction of the folds is as follows: The main vertical fold is directed so that the upper inside front panel 12U and the lower inside front panel 12L come into contact with the upper inside rear panel 14U and the lower inside rear panel 14L, respectively. After this fold is made, the unit, which should resemble FIG. 2, is folded so that the front upper panel 10U and front lower panel 10L should come together. The final result should resemble FIG. 1.

Figure 4:
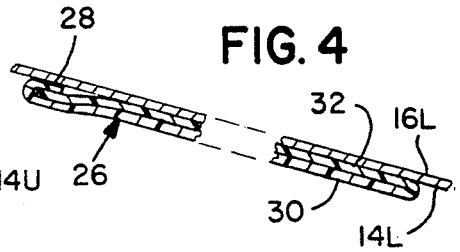
FIG. 4 is a cross sectional view taken in the direction of arrow 4—4 in FIG. 3, with parts broken away.

FIG. 4 is a cross section of the image holder 26, detailing it's construction. The image holder is constructed of a single sheet of polypropylene plastic, which is chemically inert and transparent. The selection of a chemically inert plastic is crucial to preservation of the thermographic paper that a ultrasound image is printed on.

The image holder has an image holder front 30, which is bent to form the image holder tab 28, which has a pressure sensitive adhesive backing, which is used to mount the image holder 26 to the lower inside rear panel 14L. The image holder front 30 is bent again to form an image holder back 32, which wraps around behind the image and tucks in under the image holder tab 28, after the sonographic image is placed between the image holder front 30 and image holder back 32.

Figure 5:
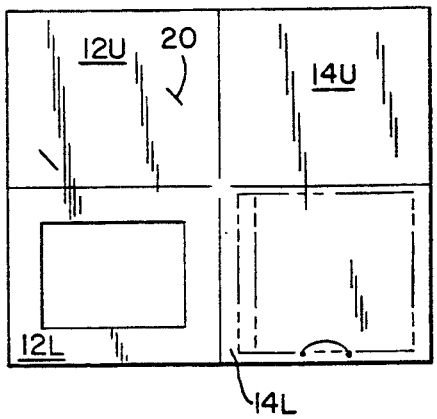
FIG. 5 is a diagrammatic elevational view of the instant invention of the side where the image holder is mounted.

FIG. 5 shows the image presentation card mounting surface, lying flat, with the image holder shown in phantom in the space it normally occupies.

What is claimed is:

1. An image presentation card comprising:

a) an image holder, constructed of a sheet of polypropylene plastic, for protecting an image comprising a sonograph printout on thermographic paper, the sheet of polypropylene plastic bent twice to create an image holder front, an image holder back, and an image holder tab where the image holder back is tucked into to form a pocket between the image holder front and the image holder back for receiving the image; and b) a mounting surface upon which the image holder is secured, the mounting surface including a circular tab means for holding the image holder to the mounting surface, a window in the mounting surface opposite the image holder, the window providing a means for framing a selected portion of the image when the image is placed in the image holder, the mounting surface further comprising a cover which can be folded to completely cover the window for protecting the image from light when the image is not being viewed.

2. An image presentation card as recited in claim 1, where the mounting surface further comprises corner slits in the mounting surface for holding a business card on the mounting surface.

3. An image presentation card comprising:

an image holder, constructed of a chemically inert polypropylene sheet bent twice to create an image holder front, an image holder back, and an image holder tab where the image holder back is tucked into to form a pocket between the image holder front and the image holder back for receiving an image comprising a sonograph printout, a pressure sensitive adhesive being provided on the image holder tab for mounting the image holder tab;

a mounting surface upon which the image holder is secured, a circular tab means on the mounting surface for holding the image holder in place in cooperation with the adhesive, and a window opposite the image holder, the mounting surface folded so that the window overlays a spot of the image holder for framing a selected portion of the image when mounted in the image holder, and to allow the image to be viewed through the window, the mounting surface further comprising a cover for completely covering the image to protect it from light when the image is not being viewed.

4. An image presentation card as recited in claim 3, where the mounting surface further comprises a pair of corner slits for allowing two corners of a business card to be inserted into the mounting surface, to hold the business card to the mounting surface.

5. An image presentation card comprising:

an image holder, constructed of a chemically inert transparent sheet bent twice to create an image holder front, an image holder back, and an image holder tab where the image holder back is tucked into to form a pocket between the image holder front and the image holder back for receiving a delicate image;

a mounted surface upon which the image holder is secured, the mounted surface including tab means for holding the image holder with the image inserted therein in place, a window opposite the image holder, the mounted surface folded so that the window overlays a spot of the image holder for framing the image when inserted in the image holder, and to allow the image to be viewed through the window, the mounted surface further comprising a cover for completely covering the image to protect it from light when the image is not being viewed.

* * * * *